US009813804B2

(12) United States Patent
Franck et al.

(10) Patent No.: US 9,813,804 B2
(45) Date of Patent: Nov. 7, 2017

(54) DEVICE AND METHOD FOR SPATIALLY SELECTIVE AUDIO REPRODUCTION

(71) Applicant: Fraunhofer-Gesellschaft zur Foerderung der angewandten Forschung e.V., Munich (DE)

(72) Inventors: Andreas Franck, Illmenau (DE); Christoph Sladeczek, Illmenau (DE); Thomas Sporer, Fuerth (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/954,913

(22) Filed: Nov. 30, 2015

(65) Prior Publication Data

US 2016/0088388 A1 Mar. 24, 2016

Related U.S. Application Data

(63) Continuation of application No. PCT/EP2014/061188, filed on May 28, 2014.

(30) Foreign Application Priority Data

May 31, 2013 (DE) ..... 10 2013 210 184
Aug. 30, 2013 (DE) ..... 10 2013 217 367

(51) Int. Cl.
*H04R 5/02* (2006.01)
*H04R 1/32* (2006.01)
*H04R 27/00* (2006.01)

(52) U.S. Cl.
CPC ..... *H04R 1/323* (2013.01); *H04R 5/02* (2013.01); *H04R 27/00* (2013.01);
(Continued)

(58) Field of Classification Search
CPC ..... H04R 27/00; H04R 1/323; H04R 5/02; H04R 2227/001; H04R 2430/01; H04R 2203/12; H04R 2430/20
(Continued)

(56) References Cited

U.S. PATENT DOCUMENTS 7,577,260 B1 8/2009 Hooley et al.
2010/0158263 A1 6/2010 Katzer et al.
(Continued)

FOREIGN PATENT DOCUMENTS

EP 1699259 A1 9/2006
JP 2001095082 A 4/2001
(Continued)

OTHER PUBLICATIONS

Daniel, A et al., "Multichannel Audio Coding Based on Minimum Audible Angles", AES 40th International Conference, Tokyo http://www.aes.org/e-lib/browse.cfm?elib=15548, Oct. 8, 2010, pp. 1-10.
(Continued)

*Primary Examiner* — Vivian Chin
*Assistant Examiner* — Con P Tran
(74) *Attorney, Agent, or Firm* — Michael A. Glenn; Perkins Coie LLP

(57) ABSTRACT

A more clear-cut separation of a first audio signal within a first region of a sonication area of a plurality of loudspeakers is achieved in that a calculator calculates that version of the audio signals which results from the spatially selective reproduction of the audio signals at this first region, in that a masking threshold is calculated as a function of the version of that audio signal which is to be separated from the one or more other audio signals at this region, and in that the emission of the audio signals for spatially selective reproduction to the outputs of the plurality of loudspeakers is influenced as a function of a comparison of the masking threshold with the version of the one or more other, i.e. spurious, audio signals.

14 Claims, 5 Drawing Sheets

(52) U.S. Cl.
CPC .... *H04R 2203/12* (2013.01); *H04R 2227/001* (2013.01); *H04R 2430/01* (2013.01); *H04R 2430/20* (2013.01)

(58) Field of Classification Search
USPC .... 381/305, 59, 58, 73.1, 98, 303, 150, 123, 381/81, 300
See application file for complete search history.

(56) References Cited

U.S. PATENT DOCUMENTS

| | | | | |
|---|---|---|---|---|
| 2012/0020480 | A1 | 1/2012 | Visser et al. | |
| 2013/0259254 | A1* | 10/2013 | Xiang | G10K 11/175 381/73.1 |
| 2014/0006017 | A1* | 1/2014 | Sen | G10L 21/003 704/208 |
| 2016/0196818 | A1* | 7/2016 | Christoph | G10K 11/1786 381/71.6 |

FOREIGN PATENT DOCUMENTS

| | | | |
|---|---|---|---|
| JP | 2013-102389 | A | 5/2013 |
| WO | 2005086526 | A1 | 9/2005 |

OTHER PUBLICATIONS

Helmrich, C.R. et al., "Improved Psychacoustic Noise Shaping for Requantization of High-Resolution Digital Audio", AES 31st International Conference, London, Jun. 25-27, 2007 http://www.aes.org/e-lib/browse.cfm?elib=13963, Jun. 25, 2007, pp. 1-10.

Ziemer, T , "A Psychoacoustic Approach to Wave Field Synthesis", 42nd International Conference: Semantic Audio http://www.aes.org/e-lib/browse.cfm?elib=15942, Jul. 2011, 7 pages.

* cited by examiner

DEVICE AND METHOD FOR SPATIALLY SELECTIVE AUDIO REPRODUCTION

CROSS-REFERENCE TO RELATED APPLICATIONS

This application is a continuation of copending International Application No. PCT/EP2014/061188, filed May 28, 2014, which is incorporated herein by reference in its entirety, and additionally claims priority from German Applications Nos. 10 2013 210 184.8, filed May 31, 2013, and 10 2013 217 367.9, filed Aug. 30, 2013, both of which are incorporated herein by reference in their entirety.

BACKGROUND OF THE INVENTION

The present invention relates to spatially selective audio reproduction, e.g. of different audio signals to different listeners or groups of listeners who are located in different positions.

Reproduction of audio signals via several loudspeakers typically organized as an array is a common method. By replicating the signal and by obtaining the loudspeaker signals by means of individual modification, e.g. by imposing a delay and a change of the amplitude, which generally can also be described as filtering, the shape of the sound field radiated by means of a loudspeaker can be influenced in a target-oriented manner, for example for the purpose of exposing specific regions to sound in a targeted manner. Said techniques will be referred to as beamforming below. By means of this technology, it is also possible to simultaneously reproduce several audio signals with different directivity characteristics by producing, for all signals, individual filtered loudspeaker signals that are summed up, loudspeaker by loudspeaker, prior to reproduction. In this manner, spatially selective reproduction may be achieved wherein several regions, so called "sound zones", are sonicated with different signals, mutual influencing of the sound reproduction among said sound regions or with other zones, so called "quiet zones", which are intended to be silent as much as possible, being minimized.

There are a multitude of algorithms for determining beamforming filters. In addition to those applying only amplitude weights and/or delays, there are also methods that are based on frequency-dependent filtering. Said methods are often based on optimization techniques and enable flexible default of a desired radiation behavior, such as a selectable radiation direction or the suppression of the radiation within definable regions, in accordance with the above-mentioned "quiet zones".

Notwithstanding such beamforming algorithms, the effectiveness of spatially selective sonication (exposure to sound), in particular of the suppression of the audible interference between sound zones, is often limited and allows no acceptable quality. The main reasons for this are the limitations of the loudspeaker arrays in terms of achieving a desired directivity behavior across the frequency domain used, the influence of the reproduction room as well as errors resulting from a limited robustness of the beamforming filters toward deviations of the loudspeakers, the signal amplitudes, etc. Thus, the possibilities of spatially selective reproduction via physical measures and measures related to signal processing are limited.

It would be desirable to have a concept for spatially selective audio reproduction that enables achieving a more clear-cut separation, at a specific region of a sonication area, of an audio signal provided for this region from one or more other audio signals that are reproduced in a superimposed manner.

SUMMARY

According to an embodiment, a device for spatially selective audio reproduction may have: an input for first and second audio signals; an output for a plurality of loudspeakers; a beamforming processor connected between the input, on the one hand, and the output, on the other hand, and is configured to emit the first and second audio signals for spatially selective reproduction to the loudspeakers via the output; a calculator configured to calculate, by means of a propagation model, for the first and second audio signals a respective version of the respective audio signal which results from the spatially selective reproduction in a first region of a sonication area of the loudspeakers; a masking threshold calculator configured to calculate a masking threshold as a function of the version of the first audio signal; and an adaptor configured to influence, as a function of a comparison of the masking threshold with the version of the second audio signal, the emission of the first and second audio signals for spatially selective reproduction to the loudspeakers via the output; the beamforming processor being configured to achieve emission of the first and second audio signals for spatially selective reproduction to the output by performing beamforming on at least the second audio signal, the beamforming processor having several modes for performing beamforming which differ from one another with regard to a quality of suppression of the second audio signal at the first region for different frequency domains, the adaptor being configured to vary the beamforming by switching from a currently used mode to a different mode as a function of the comparison.

According to another embodiment, a method for spatially selective audio reproduction by means of a beamforming processor connected between an input for first and second audio signals and an output for a plurality of loudspeakers, said beamforming processor being configured to emit the first and second audio signals for spatially selective reproduction to the loudspeakers via the output may have the steps of: calculating, by means of a propagation model for the first and second audio signals, a respective version of the respective audio signal which results from the spatially selective reproduction in a first region of a sonication switch of the loudspeakers; as a function of the version of the first audio signal, calculating a masking threshold via a psychoacoustic model; and as a function of a comparison of the masking threshold with the version of the second audio signal, influencing the emission of the first and second audio signals for spatially selective reproduction to the loudspeakers via the output; the beamforming processor being configured to achieve emission of the first and second audio signals for spatially selective reproduction to the output by performing beamforming on at least the second audio signal, the beamforming processor having several modes for performing beamforming which differ from one another with regard to a quality of suppression of the second audio signal at the first region for different frequency domains, said influencing including varying the beamforming by switching from a currently used mode to a different mode as a function of the comparison.

Another embodiment may have a computer program having a program code for performing the method as claimed in claim 13, when the program runs on a computer.

The core idea of the present invention consists in having found that improved separation of a first audio signal within a first region of a sonication area of a plurality of loudspeakers can be achieved in that the version of the audio signals which results from the spatially selective reproduction of the audio signals at this region is calculated, in that a masking threshold is calculated as function of the version of that audio signal that is to be separated from the one or the several other audio signals at this region, and in that the emission of the audio signals for spatially selective reproduction to the outputs of the plurality of loudspeakers is influenced as a function of a comparison of the masking threshold with the version of the one or more other, i.e. spurious (interfering), audio signals. Calculation or estimation of the audio signals in this first region may also be illustrated as a simulation of the sound propagation into this first region, and the element used for implementing the former can thus be illustrated as a calculator or simulator. The separation of the audio signals, which is already enabled by the spatially selective reproduction, at the first region of the sonication area may thus be improved, while evaluating the masking threshold, in that the versions of the audio signals which result from the spatially selective reproduction are calculated and/or simulated. Influencing the spatially selective reproduction for avoiding, or reducing, the "infringement upon" the masking threshold at the first region of the sonication area may be performed in different ways such as, e.g. by means of a frequency-selective reduction of the respectively spurious other audio signal in frequency domains where the respective simulated other audio signal exceeds the masking threshold. Additionally or alternatively, it is possible to amplify the audio signal that is actually of interest at corresponding frequency domains. Additionally or alternatively, it would also be feasible to vary beamforming of the (first) audio signal actually of interest, of the spurious (second) audio signal, or both audio signals as a function of the comparison with the masking threshold.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
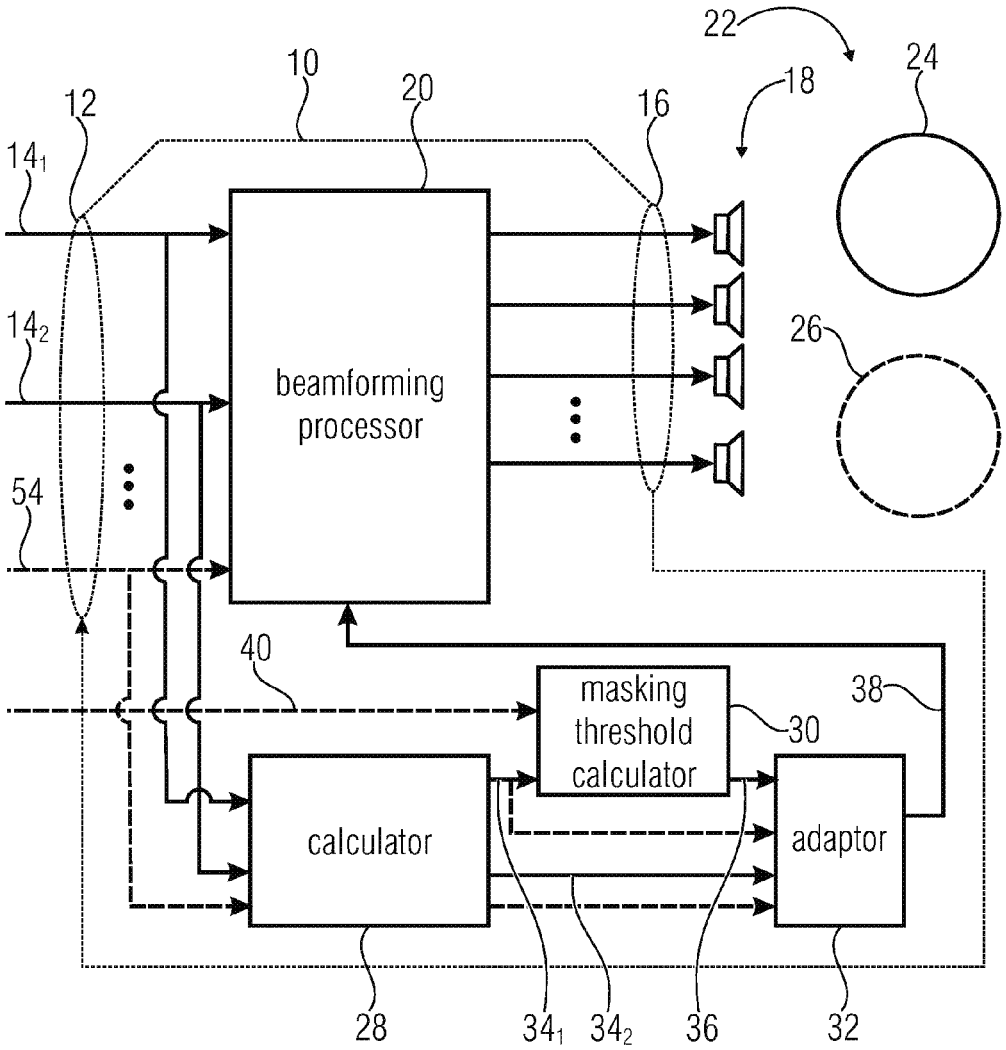
FIG. 1 shows a block diagram of a device for spatially selective reproduction.

FIG. 1 shows a device for spatially selective audio reproduction in accordance with an embodiment. Said device is generally indicated by the reference numeral 10. The device 10 includes an input 12 for at least a first audio signal $\mathbf{14}_1$ and a second audio signal $\mathbf{14}_2$ as well as an output 16 for a plurality of loudspeakers 18. A beamforming processor 20 of the device 10 is connected between the input 12, on the one hand, and the output 16, on the other hand, and is configured to output the first and second audio signals $\mathbf{14}_1$ and $\mathbf{14}_2$ for spatially selective reproduction to the loudspeakers 18 via the output 16. The loudspeakers 18 are able to sonicate a sonication area 22, e.g. an area which is surrounded by the loudspeakers at their envisaged loudspeaker locations or to which they are directed, or, generally, an area sonicated by at least one of the loudspeakers 18. The sonication area may be a fictitious room in relation to the configuration of fictitious and/or target loudspeaker positions of the loudspeakers 18, such as a virtual sonication area without any reflecting surfaces, or a real sonication area which may comprise reflection effects, e.g. on walls or the like.

"Spatially selective" reproduction of the audio signals $\mathbf{14}_1$ and $\mathbf{14}_2$ at the loudspeakers 18 is to signify that the audio signals are not simply emitted to the loudspeakers 18 in the form of mutually identical copies in a superimposed form, but that they are emitted, as is described in the introduction to the description of the present application, by means of, e.g., loudspeaker-individual delays and/or amplitude modifications or, generally, such that they are emitted via the loudspeakers 18 in a manner in which they are filtered by means of a loudspeaker-individual filtering, namely in different ways for the audio signals $\mathbf{14}_1$ and $\mathbf{14}_2$, so that there is at least one first region 24 of the sonication area that is sonicated to a lesser degree or not at all by the second audio signal $\mathbf{14}_2$ as compared to the first audio signal $\mathbf{14}_1$. There may also be a second region 26 wherein which the opposite is true, i.e. on account of the spatially selective reproduction, the first audio signal $\mathbf{14}_1$ sonicates this region 26 via the loudspeakers 18 to a lesser degree or not at all as compared to the second audio signal $\mathbf{14}_2$. Later on it shall also be pointed out that it is also possible for more than two audio signals reproduced in a superimposed manner to exist simultaneously.

Under optimum conditions it might be possible for the separation of the first audio signal $\mathbf{14}_1$ at the first region 24 from the other audio signal $\mathbf{14}_2$ to reach such a degree that a listener in this region 24 does not hear the other audio signal $\mathbf{14}_2$. Unfortunately, however, spatial selectivity is limited via the reproduction by the loudspeakers 18, which limits may originate from actually existing reflections or simply from a limited overall extension of the distribution of the positions of the loudspeakers 18. The further elements contained within the device 10 are intended to improve the "spatial selectivity" in this sense. The details to this shall be explained below.

However, it shall first be mentioned briefly that the audio signals $\mathbf{14}_1$ and $\mathbf{14}_2$ may be present at the input 12 in any form, such as in an analog or digital form, in a separated or in an m/s-encoded form, or in a form including a parametrized downmix, in an uncompressed or compressed form, within the time domain or within the frequency domain, etc. This situation is similar for the loudspeaker signals for the loudspeakers 18 at the output 16. Loudspeaker-individual loudspeaker signals for the loudspeakers 18 may be emitted via the output 16 such that they are separate from one another, may be emitted in an analog or digital, compressed or uncompressed, already amplified, only pre-amplified, or non-amplified form, etc. Similarly, it would be possible for the loudspeaker signals to be emitted in a compressed from in a downmix, together with spatial cue parameters, such as in an MPEG-Surround-encoded or SAOC-encoded form. The beamforming processor 20 processes the incoming audio signals $\mathbf{14}_1$ and $\mathbf{14}_2$ in an initially completely separate manner, for example, so as to produce for each of them a set of loudspeaker signals for the loudspeakers 18 such that each loudspeaker signal for the respective audio signal has undergone specific filtering that is individual to the respective loudspeaker position of the respective loudspeaker, such as delay and/or amplitude modification. It is only at the end that, e.g., the loudspeaker signal sets thus obtained from the individual loudspeaker signals are superimposed with one another per channel and/or loudspeaker. This shall once again be illustrated in the following figures.

Even though the region 24 and the optional region 26 in FIG. 1 are illustrated to be circular by way of example, i.e. as two-dimensional regions that are limited both in a direction passing through the loudspeakers 18 and in a direction transverse thereto, the term "spatial selectivity" shall also be understood to be broad enough, of course, to merely designate "angular selectivity", in the sense that processing that is individual to each audio signal and is performed within the beamforming processor 20 results in that the audio signals $\mathbf{14}_1$ and $\mathbf{14}_2$ are emitted into different solid-angle regions as seen from the perspective of the loudspeakers 18. Such angular selectivity may also be interpreted as influencing the radiation in the far field of the loudspeaker setup. At a small distance from the loudspeaker setup (in relation to the size of the loudspeaker setup, i.e. in the geometric near field), targeted modification of the radiation within a two-dimensional area is also feasible.

As will be explained in more detail below, the beamforming processor 20 may be fixedly set to, or optimized to, spatially selective reproduction. In other words, the spatial selectivity of the reproduction of the beamforming processor 20 may be constant. It may be optimized in advance in relation to the region 24 or the regions 24 and 26, i.e. to the effect that in the region 24, only the first audio signal $\mathbf{14}_1$ and, if provided, in the region 26, only the second audio signal $\mathbf{14}_2$, can be heard by a listener positioned within the respective region. The optimization will then define the above-mentioned delays, amplitude modifications and/or filters, e.g. FIR filters, for the individual channels and/or loudspeakers 18, and the beamforming processor 20 may be hard-wired, for example, or be fixedly implemented in software or programmable hardware so as to arrange for the spatially selective reproduction to the loudspeakers 18 via the output 16. Alternatively, it is also possible, however, for the beamforming processor to also be adjustable with regard to loudspeaker-individual processing (delay, amplitude modulation, or filtering) for one or more of the audio signals $\mathbf{14}_1$, $\mathbf{14}_2$. In general terms, the beamforming processor 20 can be adjusted and/or influenced with regard to its spatially selective reproduction of the audio signals $\mathbf{14}_1$, $\mathbf{14}_2$ at the output 16, as will be described in more detail below. Additionally or alternatively, this adjustment may also be achieved by modifying/influencing individual or all of the audio signals in a manner that is individual to each audio signal but acts on all of the loudspeakers/channels in the same manner, and is frequency selective, as will also be described below. It is the very above-mentioned ability of the beamforming processor 20 to be influenced and/or adjusted that is used by the components of the device 10 that will be described below in order to improve separation of the first audio signal $\mathbf{14}_1$ in the region 24 from the other audio signal $\mathbf{14}_2$.

In addition to the components described so far, the device 10 includes a calculator 28, a masking threshold calculator 30, and an adaptor 32. The calculator 28 is also connected to the input 12 and is configured to calculate, by means of a propagation model, for the audio signals $\mathbf{14}_1$ and $\mathbf{14}_2$, a version of the respective audio signal $\mathbf{14}_1$ and/or $\mathbf{14}_2$ that results from the spatially selective reproduction in the first region 24, i.e. the version $\mathbf{34}_1$ of the audio signal $\mathbf{14}_1$ that is reproduced at the location 24, and, likewise, the version $\mathbf{34}_2$ of the audio signal $\mathbf{14}_2$ that is reproduced at the location 24. The masking threshold calculator 30 obtains the version $\mathbf{34}_1$ and is configured to calculate a masking threshold 36 as a function thereof, and the adaptor 32 obtains the version $\mathbf{34}_2$ of the other audio signal and, optionally, possibly also the version $\mathbf{34}_1$ of the first audio signal $\mathbf{14}_1$ and is configured to influence, as a function of a comparison of the masking threshold 36 with the version of the second audio signal $\mathbf{34}_2$, emission of the first and second audio signals for spatially selective reproduction to the loudspeakers 18 via the output 16 in that the adaptor 32 controls the beamforming processor 20 in a suitable manner, as is indicated by an arrow 38. In other words, an output of the adaptor 32 is connected to a control input of the beamforming processor 20.

The calculator 28, the masking threshold calculator 30, and the adaptor 32 may each be implemented in software, programmable hardware, or in hardware. The calculator 28 may use propagation models, for example, that might also have been used for optimizing the internal, channel/loudspeaker-individual processing of the audio signals $\mathbf{14}_1$, $\mathbf{14}_2$ within the beamforming processor 20. The calculator 28 calculates or estimates, for example, as will be described in more detail below, the sound events produced at the location 24 by the first audio signal $\mathbf{14}_1$ and the second audio signal $\mathbf{14}_2$. For calculating, said calculator may use, for example, the channel/loudspeaker-individual processing of the audio signals $\mathbf{14}_1$, $\mathbf{14}_2$ within the beamforming processor 20 and the positions of the loudspeakers 18 and, optionally, further parameters such as radiation patterns and/or alignment of the loudspeakers 18, for example. The calculator 28 calculates the sound events that are measured or represented in sound pressure, amplitude or the like, for example, and possibly in a frequency-dependent manner, i.e. for different frequencies. In the event of constant/fixed channel/loudspeaker-individual processing of the beamforming processor 20, the calculator 28 may perform the simulation in a constant/fixed manner. Allowance for and/or adaptation to the channel/loudspeaker-individual processing on the part of the processor 20 will then be due to the suitable interpretation of the propagation model that the calculator 28 uses for calculating the versions $\mathbf{34}_1$, $\mathbf{34}_2$. Thus, the propagation model may also take into account the parameters just mentioned. In turn, the calculator 28 may emit the versions $\mathbf{34}_1$ and $\mathbf{34}_2$ in any form, i.e. in an analog or digital form, in a compressed or uncompressed form, within the time domain or within the frequency domain, or the like.

The masking threshold calculator 30 calculates a masking threshold as a function of the version $\mathbf{34}_1$, i.e. of the audible version of the audio signal $\mathbf{14}_1$ at the location 24. As is indicated by a dashed arrow 40, the masking threshold calculator may also use, in addition to the version $\mathbf{34}_1$, a background audio signal (e.g. noise or driving noises) for calculating the masking threshold. The calculation takes into account any temporal and/or spectral auditive masking effects. The masking threshold calculated thus indicates, as a function of the frequency, to what extent the version $\mathbf{34}_1$ of the audio signal $\mathbf{14}_1$ at the location 24 is capable of rendering other audio signals inaudible to a listener at the location 24 by masking them. For example, the masking threshold calculator 30 may be configured such that it determines and/or calculates the masking threshold in a frequency resolution that is becoming increasingly coarse as the frequency increases, i.e. wherein the frequency bands are becoming increasingly wide as the frequency increases, such as in a Bark frequency resolution, for example.

The adaptor 32 compares the masking threshold 36 with the version $\mathbf{34}_2$ of the second audio signal $\mathbf{14}_2$ and in this manner ascertains, for example, whether the second audio signal $14_2$ is audible to a person at the location 24, i.e. whether the second audio signal exceeds the masking threshold at any frequency. If this is so, the adaptor 32 takes countermeasures and controls the beamforming processor 20 in a suitable manner. Several examples for such control operations were already indicated above. This shall be illustrated once again with reference to the following figures.

Figure 2:
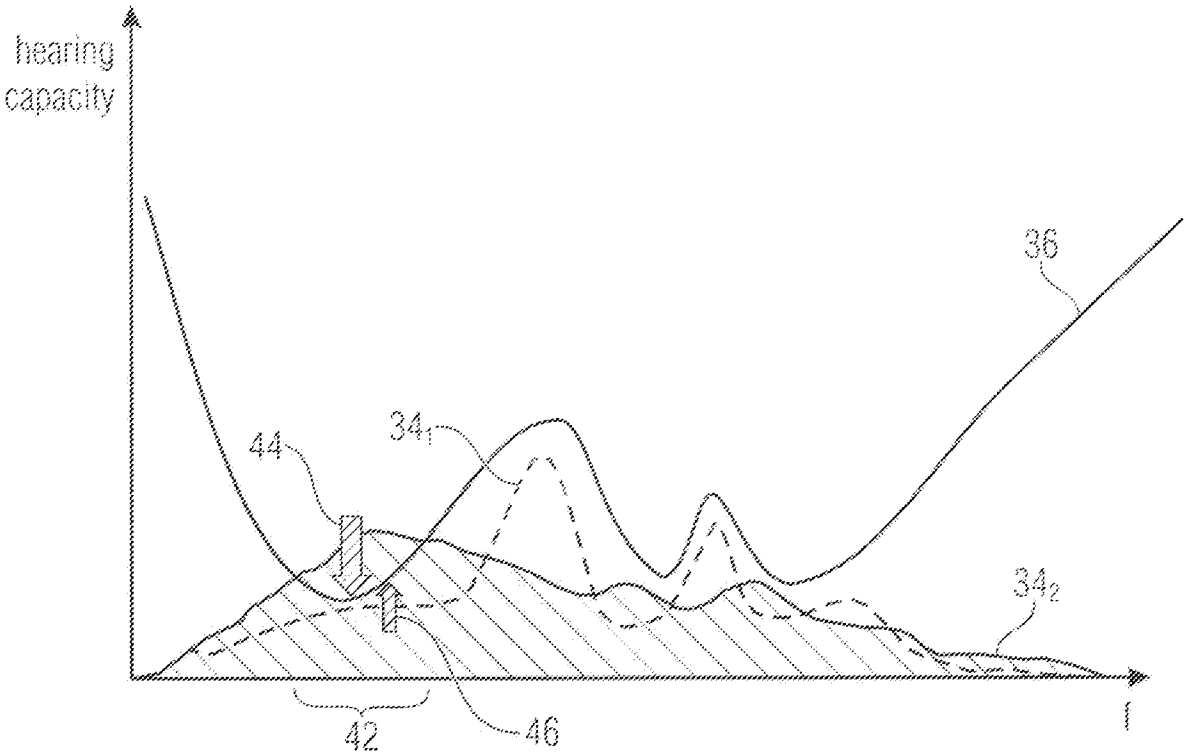
FIG. 2 shows a sketch for illustrating possible measures taken by the adaptor of FIG. 1.

For example, FIG. 2 shows a diagram that is plotted over the frequency f, the masking threshold 36, the version $34_1$, and the version $34_2$ in a virtual scale measuring the hearing capacity. A frequency domain 42, wherein the spurious audio signal $14_2$, or the version $34_2$ resulting at the location 24 in accordance with the simulation, currently exceeds the masking threshold 36 is illustrated by way of example. One possible countermeasure would consist in the adaptor 32 controlling the beamforming processor 20 such that within said frequency domain 42 the second audio signal $34_2$ is reduced, as is indicated by an arrow 44. Additionally or alternatively, the adaptor 32 might control the beamforming processor 20 such that within this frequency domain—or, beyond said frequency domain 42, possibly even independently of the frequency—the first audio signal $14_1$ is amplified, as is indicated by an arrow 46. Reduction 44 and/or amplification 46 are advantageously performed such that the degree of amplification/reduction exhibits no abrupt leaps in time and/or frequency. The degree and/or the value of the reduction and/or amplification is temporally and/or spectrally smoothened.

The possible measures that were explained with reference to FIG. 2 so far and that might be taken by the adaptor 32 against an audibility of the version $34_2$ at the location 24 related to global measures in terms of spatial selectivity and/or in terms of channel/loudspeaker and/or measures that are equally effective for all channels/loudspeakers 18. It will be shown later on that the beamforming processor 20 performs, e.g., amplification 46 and/or reduction 44 on the respective incoming audio signal $14_1$ or $14_2$ in advance and only thereafter performs channels/loudspeaker-individual processing of the equally preprocessed audio signals for spatially selective reproduction. Additionally or alternatively, the adaptor 32 may be configured to vary the beamforming itself as a function of the above-mentioned comparison with the masking threshold 36, as was already indicated above. This shall be illustrated with reference to FIG. 3.

Figure 3:
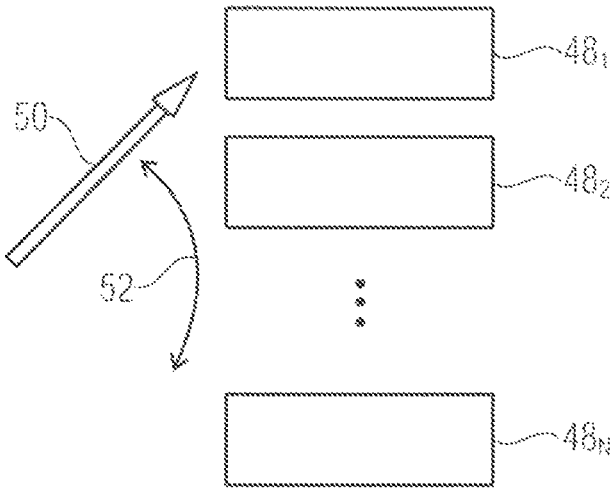
FIG. 3 illustrates a sketch for illustrating an additional or alternative measure taken by the part of the adaptor of FIG. 1.

FIG. 3 shows that the beamforming processor 20 may comprise, e.g., several options or modes for channel/loudspeaker-individual beamforming processing of the audio channels $14_1$ and $14_2$, said different modes here being indicated by $48_1$ to $48_N$ by way of example. One of these—e.g. beamforming processing in accordance with $48_1$—might be optimum processing, in terms of certain criteria, for spatially selective reproduction, i.e. might possibly result in a best suppression of the audio signal $14_2$ and/or $34_2$ at the location 24 in terms of location and frequency. However, the other modes $24_2$ to $48_N$ might also possibly result in similarly good separations or even in equally good or even optimum separations in terms of other criteria or criteria weighted differently. All modes $48_1$ to $48_N$ might comprise, e.g. differences with regard to the quality of suppression for different frequency domains, and in this case, for example, the adaptor 32 might change a currently selected channel/loudspeaker-individual processing mode, or switch from same to another one, as a function of the comparison with the masking threshold 36 and a location of an interval 42 wherein an infringement upon the masking threshold 36 exists; in FIG. 3, an arrow 50 is to indicate, e.g., the selection of a currently selected mode $48_1$ to $48_N$, and a double arrow 52 is to indicate the switch from this mode currently used by the beamforming processor 20 to a different one as a function of the above-mentioned comparison with the masking threshold 36. The switch from one mode to another might be accompanied, in the beamforming processor 20, by loudspeaker/channel-individual fading between a loudspeaker signal obtained with the most recent mode and a loudspeaker signal obtained with the new mode.

On account of the calculator 28, the masking threshold 30, and the adaptor 32, the device 10 of FIG. 1 thus is able to improve suppression of another audio signal $14_2$ at a location 24 of the sonication area of the loudspeaker setup 18 as compared to a constant beamforming separation optimized for this purpose. Various measures are possible in order to avoid potential deterioration of the audio quality of the first and/or second audio signal(s) at the location 24 and/or location 26 by the masking threshold-controlled modification. As was already mentioned above, the degree of the amplification 46 and/or reduction 44 may be limited both with regard to its absolute value, i.e. the intensity of the amplification 46 and/or the intensity of the reduction 44, but also with regard to the change of this value in time and/or frequency. In the event of using the possibility of FIG. 3, fading may be used, for example, for switching from the one mode to the other mode. On this occasion it is worthwhile to point out that in addition to the processing delay resulting from the processing operations aimed at performing spatially-selective reproduction in the beamforming processor 20, a delay may also be provided for performing a processing delay adaptation to the processing delay which is caused by the series of processing operations within the calculator 28, the masking threshold calculator 30, and the adaptor 32. In this manner it is possible that the adaptations performed by the adaptor 32 are applied, in a temporally correct and/or a temporally synchronized manner, to the audio signals $14_1$ and $14_2$ from which the control data for the adaptation has been obtained. Such an additional delay in the path of the beamforming processor 20 as compared to the processing within the path along the calculator 28, the masking threshold calculator 30, and the adaptor 32 might also be used for making the above-mentioned fade-overs between different beamforming modes $48_1$ to $48_N$ easier.

Before a specific implementation of a device for spatially selective reproduction will be described below so as to describe possible configurations of the elements that were already mentioned above, it shall be noted that in the event of the switching between modes in accordance with FIG. 3, a continuous change in the channel/loudspeaker-individual processing may also be possible in that a corresponding parameter is not changed, but may be changed by the modification 52 in a continuous manner. As was already mentioned, the channel/loudspeaker-individual processing operations 48 are based, e.g., on a set of delays for each channel/loudspeaker for at least the audio signal $48_2$, but possibly also for both audio signals $14_1$ and $14_2$, and/or corresponding amplitude changes or filter coefficients for FIR filters.

Finally, it shall also be noted that it is possible to provide more than only two audio signals $14_1$ and $14_2$. This is indicated by a dashed arrow 54 in FIG. 1. The above description is readily applicable to this case. Additional audio signals 54 would be treated, e.g., just like the audio signal $14_2$, i.e. as audio signals, the reproduction of which at the location 24 is supposed to be inaudible to a listener positioned at this location 24.

In yet other words, the above embodiment this allows improvement of the perceived quality of space-related reproduction by taking into account psychoacoustic effects. In this context, the fact that an audio signal can prevent audibility of components of another, more quiet signal is made use of. This effect is referred to as masking. This plays a vital part in lossy audio encoding, for example. In psychoacoustics, one distinguishes between masking in the time and the frequency domains. In masking in the time domain, a loud signal, the so called masker, masks other components that occur shortly after or, within narrow limits, even before this sound event. In masking in the frequency domain, a signal component having a specific frequency will mask other components having a similar frequency and a lower amplitude. The threshold up to which masking occurs depends on the frequency and the absolute level of the masker and on the distance between the frequencies of the masker and other signal. The masking thresholds and, thus, the decision whether a signal component will be masked can be determined via psychoacoustic models. The masking threshold calculator 30 may use such psychoacoustic models.

Figure 4:
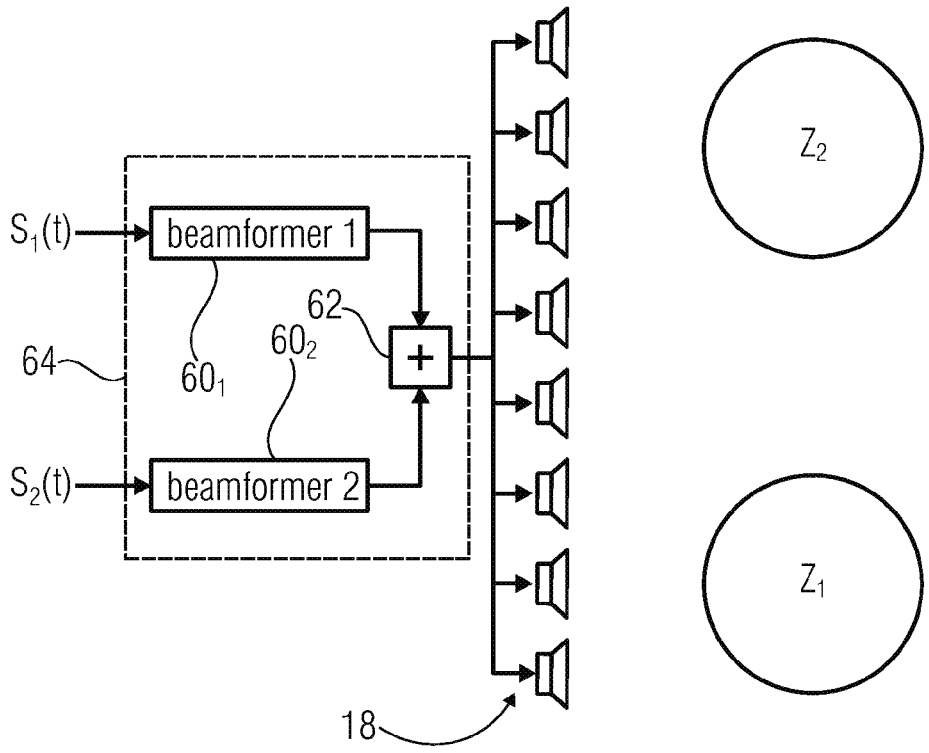
FIG 4 (PRIOR ART)
FIG. 4 shows a block diagram of a conventional device for spatially selective reproduction.

As was already indicated above, a possible implementation of the embodiment of FIG. 1 will be described below. The technical details on this are to be individually transferable to the individual elements of FIG. 1. However, before this implementation will be described with reference to FIG. 5, the basic setup for spatially selective reproduction shall be described with reference to FIG. 4, which will then be improved, in accordance with the above embodiment, with the implementation of FIG. 5. FIG. 4 shows how two audio signals $S_1(t)$ and $S_2(t)$ are processed, via two beamforming filter sets $\mathbf{60}_1$ and $\mathbf{60}_2$, a summation stage 62, and a loudspeaker array consisting of loudspeakers 18, such that said signals are reproduced in the regions $Z_1$ and $Z_2$, i.e. that the audio signal $S_1(t)$ is reproduced mainly within the region $Z_1$, and the audio signal $S_2(t)$ mainly in the region $Z_2$. However, due to the physical limitations of the setup, ideal separation is not possible, as was already described above. The components $\mathbf{60}_1$, $\mathbf{60}_2$, and 62 form a simple beamforming processor 64 which works in a constant manner, for example, and is optimized to perform the above-mentioned separation. The beamformer $\mathbf{60}_1$ subjects the incoming audio signal $S_1(t)$ to beamforming so as to produce a set of loudspeaker signals for said signal, and the same is done by the beamformer $\mathbf{60}_2$ for the second audio signal $S_2(t)$. Both beamformers $\mathbf{60}_{1,2}$ output their loudspeaker signal sets to the summer 62, which sums said loudspeaker signals in a channel/loudspeaker-individual manner and feeds same to the loudspeakers 18.

Figure 5:
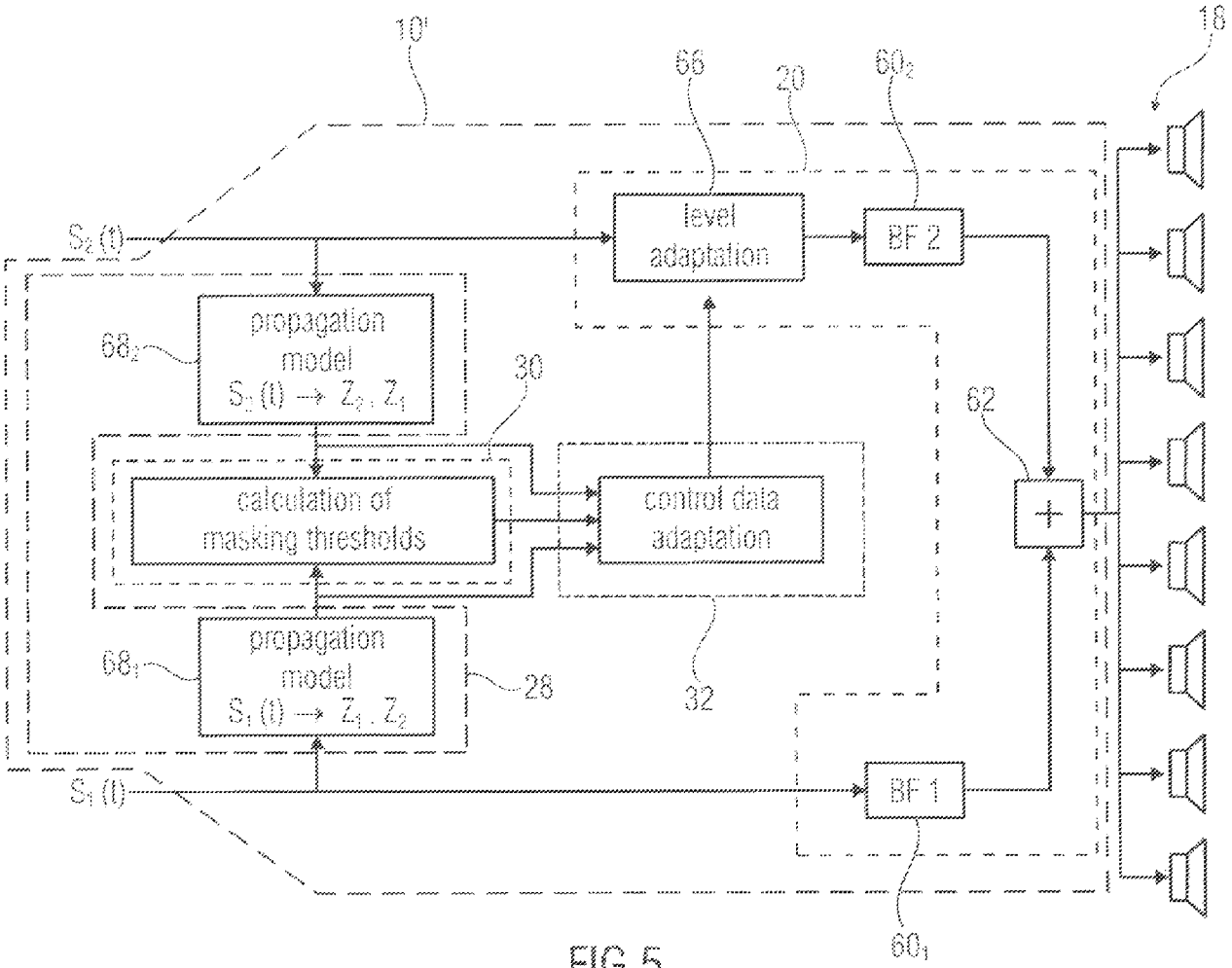
FIG. 5 shows a block diagram of an implementation variant of the embodiment of FIG. 1 with a starting point.

FIG. 5 now shows how the setup of FIG. 4 in accordance with the embodiment of FIG. 1 may be improved. The device of FIG. 5 is indicated by 10, and otherwise the reference numerals of FIG. 1 have been taken over so as to indicate parts that correspond to those indicated in FIG. 1 in terms of their functions. As can be seen, the beamforming processor 20 of FIG. 5 is modified, by way of example, as compared to the starting point of FIG. 4, merely in that here, a level adaptor 66 has been inserted into the signal path of the spurious audio signal $S_2$ on the input side of the beamformer $\mathbf{60}_2$ by way of example, even though it would also be possible for the level adaptor 66 to perform a level adaptation that has an equal effect on all of the channels/loudspeakers 18. The level adaptor 66 is controlled by the adaptor 32 to perform the reduction 44 illustrated above with reference to FIG. 2. In addition, FIG. 5 shows that the signal separation from other audio signals that was performed for one of the audio signals may also be performed for more than one audio signal. In the present case, the calculator 28 simulates, by means of corresponding propagation models which correspond to the beamforming operations performed by the beamformers $\mathbf{60}_1$ and $\mathbf{60}_2$, for both audio signals 60 $S_1$ and $S_2$ the respective audible version at both locations, namely locations $Z_1$ and $Z_2$. This is why FIG. 5 shows a propagation model applier $\mathbf{68}_1$ applying the corresponding propagation models to the audio signal $S_1$, as well as a propagation model applier $\mathbf{68}_2$ performing same for the audio signal $S_2$. The masking threshold calculator 30 performs a masking threshold calculation for the respective version for which the respective audio signal is provided at the respective location, i.e. the audible version of the audio signal $S_2$ at the location $Z_2$ and the audible version of the signal $S_1$ at the location $Z_1$, and forwards the results, i.e. the respective masking threshold for the locations $Z_1$ and $Z_2$, i.e. the masking effected by the signal $S_1$ at the location $Z_1$ and/or the masking effected by the audio signal $S_2$ at the location $Z_2$, to the control data adaptation, or the adaptor 32, which in addition thereto will keep the audible versions that are interfering in each case, i.e. the audible version of the signal $S_2$ at the location $Z_1$ and the audible version of the signal $S_1$ at the location $Z_2$.

In order to improve the situation as compared to FIG. 4, the masking thresholds of the audibility of the signal $S_2$ in zone $Z_1$ are determined in the device of FIG. 5. To this end, the signals resulting from the signals $S_1(t)$ and $S_2(t)$ initially are determined within the zone $Z_1$, such as the magnitudes within the frequency domain, for example. To this end, a propagation model is calculated or used which includes the transfer function of the loudspeaker array of loudspeakers 18. The signals are referred to as $S_1(t, Z_1)$ and $S_2(t, Z_1)$. As in the psychoacoustic model, the masking thresholds for the audibility of the signal $S_2(t, Z_1)$ are determined while using the masker $S_1(t, Z_1)$. On the basis of said thresholds, values of change are determined (for specific frequency domains) for the magnitudes of the audio signal $S_1(t)$ in one component. In addition to the masking thresholds, other psychoacoustically motivated parameters may be taken into account, such as maximally allowed changes in the signal $S_1(t)$, for example, so as to limit the effects of the adaptations made by the adaptor 32 on the reproduction of $S_1(t)$ in $Z_1$. Optionally, the time course of the change in magnitudes is also limited so as to avoid erratic, potentially interfering changes. The parameters of said time control may also be determined by psychoacoustic parameters.

The same algorithm as has just been described might simultaneously be used for minimizing the influence of $S_1(t)$ on the reproduction of $S_2(t)$ within the zone $Z_2$, as is indicated by the fact given in FIG. 5, namely that the simulation for calculating the audible versions is also performed at the location $Z_2$ as well as the calculation of the masking threshold at this location, even though said calculations might also be dispensed with in FIG. 5. Accordingly, a level adaptor might also be inserted, in FIG. 5, in the signal path of the audio signal $S_1$, which is controlled by the adaptor 32 on the basis of a comparison of the masking threshold for the location $Z_2$ with the spurious audio signal $S_1$ at the location $Z_2$. Since the adaptor 32 knows the results of all of the comparisons, i.e. the result of the comparison of the masking threshold in $Z_2$ with $S_1$ at the location $Z_2$ and the result of the comparison of the masking threshold in $Z_1$ with $S_2$ at the location $Z_1$, the adaptor is able to calculate therefrom, for all of the locations and/or regions $Z_{1/2}$, a reduction of the influence on the signal that has an interfering effect in each case, i.e. $S_2$ in $Z_1$ and $S_1$ in $Z_2$, on the signal desired, i.e. $S_2$ in $Z_2$ and $S_1$ in $Z_1$. It is possible for the adaptor 32 to make compromises for this purpose since the interferences in the individual regions involve taking measures that signify a deterioration in the other region, or regions. This compromise might be influenced by the fact that the adaptor 32 obtains a priority among the regions and the associated desired signals, so that the negative influence that is exerted on signals having higher priorities by other signals is realized, at their respective destinations, with a higher priority than for signals having lower priorities.

Of course, the number of audio signals may exceed two audio signals, as in the above embodiments.

Thus, the signal flow of the concept, or algorithm, is represented in FIG. 5 such that the acoustic event such as the sound pressure, the magnitude, etc. within the zone $Z_1$ is determined from the signals $S_1(t)$ and $S_2(t)$ by means of an acoustic propagation model.

This propagation model is typically a function of the frequency and produces a discrete amount of values, each of which is associated with a frequency. In the simplest case, the transfer function of the beamformer $\mathbf{60}_1$ to one point, such as the center of the zone $Z_1$, for example, is used as the propagation model. However, other models may also be used, for example a weighted average of the magnitude transfer function to a dot grating in $Z_1$. The core property of the propagation mode is that it translates an input signal $S_1(t)$ to a measure that describes the intensity of the sound incidence, originating from this signal, in zone $Z_1$, specifically for each of the frequency bands considered. The subdivision of the audio frequency domain into frequency bands may be effected in different ways; however, what is useful are subdivisions oriented by psychoacoustic properties, such as Constant Q or Bark scale, for example. The starting values of the psychoacoustic model may be output, for example, with a lower frequency than the audio sampling rate. This can be effected, for example, by means of subsampling or via forming a moving average with, e.g. decimation. The starting values of the masking threshold calculator are still raw control data in the embodiment of FIG. 5, which data describes a desired level change in the individual frequency bands. Said data is also defined via a grating of frequency bands and is typically present in a lower rate than the audio sampling rate. The raw control data is post-processed within the adaptor. Upper and lower limits to the level change of individual frequency domains may be specified in this module. On the other hand, the time course of the changes may be adapted, for example, by delaying and smoothing the level changes.

The adapted control signals of the adaptor are used within the level adaptor to adapt the signal $S_1(t)$ prior to filtering with the loudspeaker-specific beamforming filters within the beamformer $\mathbf{60}_2$, frequency band by frequency band, in terms of level. Thus, the level adaptor 66 acts as a multiband equalizer. In connection with the temporal dynamics of the adaptor, a function, similar to a multiband compressor, or, more generally, multiband dynamic influencing is achieved, said units here using a different signal for controlling the amplification values, in contrast to normal use.

As is shown in FIG. 5, the signal $S_2(t)$ may be adaptively changed in a similar manner so as to reduce the interference of $S_2(t)$ within the zone $Z_1$. Thus, it is also possible to simultaneously reduce crosstalk. Of course, this possibility also exists more generally for the example of FIG. 1, irrespective of the details of FIG. 5.

In addition to the above embodiments, a reference signal 40 may optionally also be used for ambient noise, such as general background noise levels, indoor noise in automotive applications or the like. This signal 40 may be used as an additional input for masking threshold calculation as was described above. The reference signal 40 is advantageously a measurement value or a useful estimation value for the ambient noise signal within the "sound zones" 24 and/or 26 or $Z_1$ in $Z_2$.

In addition, it is possible to achieve, in one (or more) zone, only the reduction of the crosstalk from the other sources rather than the undisturbed reproduction of a signal.

Thus, the above embodiments described a concept for spatially selective reproduction with loudspeaker arrays by means of psychoacoustic ambient effects, spatial reproduction of audio signals via a plurality of loudspeakers that may be arranged in an array, for example. In particular, it was described how different audio signals may be radiated into various spatial regions, so that mutual influencing is minimized or clearly reduced. In some embodiments, this has been effected by combining beamforming algorithms with a psychoacoustic model which modifies the audio signals such that the audibility of the spurious signals is reduced by the psychoacoustic masking on the part of the useful signal.

Even though some aspects have been described within the context of a device, it is understood that said aspects also represent a description of the corresponding method, so that a block or a structural component of a device is also to be understood as a corresponding method step or as a feature of a method step. By analogy therewith, aspects that have been described in connection with or as a method step also represent a description of a corresponding block or detail or feature of a corresponding device. Some or all of the method steps may be performed by a hardware device (or by using a hardware device), such as a microprocessor, a programmable computer or an electronic circuit. In some embodiments, some or several of the most important method steps may be performed by such a device.

Depending on specific implementation requirements, embodiments of the invention may be implemented in hardware or in software. Implementation may be effected while using a digital storage medium, for example a floppy disc, a DVD, a Blu-ray disc, a CD, a ROM, a PROM, an EPROM, an EEPROM or a FLASH memory, a hard disc or any other magnetic or optical memory which has electronically readable control signals stored thereon which may cooperate, or cooperate, with a programmable computer system such that the respective method is performed. This is why the digital storage medium may be computer-readable.

Some embodiments in accordance with the invention thus comprise a data carrier which comprises electronically readable control signals that are capable of cooperating with a programmable computer system such that any of the methods described herein is performed.

Generally, embodiments of the present invention may be implemented as a computer program product having a program code, the program code being effective to perform any of the methods when the computer program product runs on a computer.

The program code may also be stored on a machine-readable carrier, for example.

Other embodiments include the computer program for performing any of the methods described herein, said computer program being stored on a machine-readable carrier.

In other words, an embodiment of the inventive method thus is a computer program which has a program code for performing any of the methods described herein, when the computer program runs on a computer.

A further embodiment of the inventive methods thus is a data carrier (or a digital storage medium or a computer-readable medium) on which the computer program for performing any of the methods described herein is recorded.

A further embodiment of the inventive method thus is a data stream or a sequence of signals representing the computer program for performing any of the methods described herein. The data stream or the sequence of signals may be configured, for example, to be transferred via a data communication link, for example via the internet.

A further embodiment includes a processing means, for example a computer or a programmable logic device, configured or adapted to perform any of the methods described herein.

A further embodiment includes a computer on which the computer program for performing any of the methods described herein is installed.

A further embodiment in accordance with the invention includes a device or a system configured to transmit a computer program for performing at least one of the methods described herein to a receiver. The transmission may be electronic or optical, for example. The receiver may be a computer, a mobile device, a memory device or a similar device, for example. The device or the system may include a file server for transmitting the computer program to the receiver, for example.

In some embodiments, a programmable logic device (for example a field-programmable gate array, an FPGA) may be used for performing some or all of the functionalities of the methods described herein. In some embodiments, a field-programmable gate array may cooperate with a microprocessor to perform any of the methods described herein. Generally, the methods are performed, in some embodiments, by any hardware device. Said hardware device may be any universally applicable hardware such as a computer processor (CPU), or may be a hardware specific to the method, such as an ASIC.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A device for spatially selective audio reproduction, comprising an input for a first audio signal and a second audio signal;

an output for a plurality of loudspeakers;

a beamforming processor connected between the input, on the one hand, and the output, on the other hand, and configured to emit the first audio signal and the second audio signal for spatially selective reproduction to the loudspeakers via the output;

a calculator configured to calculate, by means of a propagation model, for each of the first audio signal and the second audio signal a respective version of the respective audio signal which results from the spatially selective reproduction in a first region of a sonication area of the loudspeakers;

a masking threshold calculator configured to calculate, via a psychoacoustic model, a masking threshold as a function of the version of the first audio signal; and an adaptor configured to influence, as a function of a comparison of the masking threshold with the version of the second audio signal, the emission of the first audio signal and the second audio signal for spatially selective reproduction to the loudspeakers via the output;

the beamforming processor being configured to achieve emission of the first audio signal and the second audio signal for spatially selective reproduction to the output by performing beamforming on at least the second audio signal, the beamforming processor comprising several modes for performing beamforming which differ from one another with regard to an amount of suppression of the second audio signal at the first region for different frequency domains, the adaptor being configured to vary the beamforming by switching from a currently used mode to a different mode as a function of the comparison.

2. The device as claimed in claim 1, further comprising a plurality of loudspeakers.

3. The device as claimed in claim 1, wherein the beamforming processor is configured to perform beamforming on the second audio signal so as to acquire a first plurality of loudspeaker signals, and to apply the loudspeaker signals acquired from the second audio signal to the loudspeakers via the output.

4. The device as claimed in claim 3, wherein the beamforming processor is configured to subject the first audio signal to beamforming so as to acquire a second plurality of loudspeaker signals, and to apply the second plurality of loudspeaker signals to the loudspeakers via the output by means of superposition with the first plurality of loudspeaker signals.

5. The device as claimed in claim 4, wherein the beamforming processor is configured to perform the beamforming on the first audio signal and the second audio signal differently—for spatially selective reproduction in different regions of the sonication area—so that for each region, one of the first audio signal and the second audio signal represents a target signal, whereas the respectively other of the first audio signal and the second audio signal represents a spurious signal in the respective region.

6. The device as claimed in claim 5, wherein the calculator is configured to calculate, by means of the propagation model, for each audio signal and for each of the different regions a respective version of the respective audio signal which results from the spatially selective reproduction in the respective region of the sonication area of the loudspeakers, the masking threshold calculator is configured to calculate a region-related masking threshold for each region of the sonication area as a function of the version, which results from the spatially selective reproduction in the respective region of the sonication area of the loudspeakers, of that audio signal which represents a target signal for the respective region; and the adaptor is configured to influence the emission of the audio signals for spatially selective reproduction to the loudspeakers via the output on the basis of the comparison of the region-related masking threshold for each of the regions with an interference which results from the version of that audio signal which represents a spurious signal in the respective region.

7. The device as claimed in claim 6, wherein the number of the audio signals is larger than two.

8. The device as claimed in claim 1, wherein the masking threshold calculator is configured to take into account a background audio signal when calculating the masking threshold as a function of the version of the first audio signal.

9. The device as claimed in claim 1, wherein the adaptor is configured to control the beamforming processor such that within frequency domains in which the version of the second audio signal exceeds the masking threshold, the second audio signal is globally reduced in the spatially selective reproduction.

10. The device as claimed in claim 1, wherein the adaptor is configured to control the beamforming processor such that within frequency domains in which the version of the second audio signal exceeds the masking threshold, the first audio signal is globally reduced in the spatially selective reproduction.

11. The device as claimed in claim 1, wherein the adaptor is configured to limit the change in the emission of the first audio signal and the second audio signal with regard to an absolute value and/or with regard to a rate of change of the value of the change.

12. The device as claimed in claim 1, wherein the calculator is configured to take temporal and spectral auditive masking effects into account in the calculation.

13. A method for spatially selective audio reproduction by means of a beamforming processor connected between an input for first audio signal and second audio signal and an output for a plurality of loudspeakers, said beamforming processor being configured to emit the first audio signal and the second audio signal for spatially selective reproduction to the loudspeakers via the output, comprising:

calculating, by means of a propagation model for each of the first audio signal and the second audio signal, a respective version of the respective audio signal which results from the spatially selective reproduction in a first region of a sonication switch of the loudspeakers;

as a function of the version of the first audio signal, calculating a masking threshold via a psychoacoustic model; and as a function of a comparison of the masking threshold with the version of the second audio signal, influencing the emission of the first audio signal and the second audio signal for spatially selective reproduction to the loudspeakers via the output;

the beamforming processor being configured to achieve emission of the first audio signal and the second audio signal for spatially selective reproduction to the output by performing beamforming on at least the second audio signal, the beamforming processor comprising several modes for performing beamforming which differ from one another with regard to an amount of suppression of the second audio signal at the first region for different frequency domains, said influencing comprising varying the beamforming by switching from a currently used mode to a different mode as a function of the comparison.

14. A non-transitory computer-readable storage medium storing a computer program comprising a program code for performing the method as claimed in claim 13, when the program runs on a computer.

* * * * *